US006776681B2

(12) United States Patent
Willett

(10) Patent No.: US 6,776,681 B2
(45) Date of Patent: Aug. 17, 2004

(54) ANIMATED DOLL

(75) Inventor: William Willett, Irvine, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/851,539

(22) Filed: May 7, 2001

(65) Prior Publication Data

US 2002/0164922 A1 Nov. 7, 2002

(51) Int. Cl.[7] ..... A63H 3/36; A63H 3/00

(52) U.S. Cl. ..... 446/300; 446/301; 446/330; 446/337; 446/343; 446/98; 446/298; 446/391; 446/392

(58) Field of Search ..... 446/268, 270, 446/272, 274, 278, 297, 300, 301, 330, 337, 342, 296, 289, 354, 352, 376, 390

(56) References Cited

U.S. PATENT DOCUMENTS

| | | | | | |
|---|---|---|---|---|---|
| 248,115 | A | | 10/1881 | Stearns, Jr. | |
| 2,948,069 | A | * | 8/1960 | Johnson | 40/416 |
| 3,298,130 | A | | 1/1967 | Ryan | |
| 3,310,907 | A | * | 3/1967 | Robbins | 446/385 |
| 3,665,644 | A | * | 5/1972 | Rapp | 446/355 |
| 3,767,901 | A | | 10/1973 | Black et al. | |
| 3,882,633 | A | * | 5/1975 | Goldfarb et al. | 446/369 |
| 3,912,694 | A | | 10/1975 | Chiappe et al. | |
| 3,921,332 | A | * | 11/1975 | Terzian et al. | 446/380 |
| 4,027,423 | A | * | 6/1977 | Barlow et al. | 446/268 |
| 4,107,462 | A | | 8/1978 | Asija | |
| 4,139,968 | A | | 2/1979 | Milner | |
| 4,177,589 | A | | 12/1979 | Villa | |
| 4,207,704 | A | | 6/1980 | Akiyama | |
| 4,231,184 | A | | 11/1980 | Corris et al. | |
| 4,245,430 | A | | 1/1981 | Hoyt | |
| 4,318,245 | A | | 3/1982 | Stowell et al. | |
| 4,516,950 | A | | 5/1985 | Berman et al. | |
| 4,521,205 | A | | 6/1985 | Spector | |
| 4,565,487 | A | | 1/1986 | Kroczynski | |
| 4,579,540 | A | | 4/1986 | Ho | |
| 4,659,919 | A | | 4/1987 | Price | |
| 4,660,033 | A | | 4/1987 | Brandt | |
| 4,696,653 | A | | 9/1987 | McKeefery | |
| 4,710,145 | A | | 12/1987 | Hall Vandis | |
| 4,729,563 | A | | 3/1988 | Yokoi | |
| 4,767,374 | A | | 8/1988 | Yang | |
| 4,775,352 | A | | 10/1988 | Curran et al. | |
| 4,799,678 | A | * | 1/1989 | Terzian et al. | 273/237 |
| 4,802,879 | A | | 2/1989 | Rissman et al. | |
| 4,808,142 | A | | 2/1989 | Berliner | |
| 4,809,335 | A | | 2/1989 | Rumsey | |
| 4,820,233 | A | * | 4/1989 | Weiner | 434/308 |
| 4,825,136 | A | | 4/1989 | Farhat | |
| 4,828,527 | A | | 5/1989 | Spector | |
| 4,843,497 | A | * | 6/1989 | Leyden | 360/79 |
| 4,846,693 | A | | 7/1989 | Baer | |
| 4,850,930 | A | | 7/1989 | Sato et al. | |
| 4,855,725 | A | | 8/1989 | Fernandez | |
| 4,864,607 | A | | 9/1989 | Mitamura et al. | |
| 4,900,289 | A | * | 2/1990 | May et al. | 446/342 |

(List continued on next page.)

FOREIGN PATENT DOCUMENTS

| | | | | |
|---|---|---|---|---|
| FR | 2297066 A | * | 9/1976 | A63H/3/36 |
| WO | WO 87/07522 | | 12/1987 | |
| WO | WO 96/15837 | | 5/1996 | |

*Primary Examiner*—Derris H. Banks
*Assistant Examiner*—Dmitry Suhol
(74) *Attorney, Agent, or Firm*—Kolisch Hartwell, P.C.

(57) ABSTRACT

An animated doll having an enlarged head and enlarged feet relative to its body, and including a combination of independent, interactive features. The interactive features include a head position assembly, which controls rotation of the head, and an eye assembly mechanism, which drives and controls the opening and closing of eyelids on the doll. The doll may also include a communication port to receive removable external components, which are associated with a pre-recorded response.

19 Claims, 5 Drawing Sheets

U.S. PATENT DOCUMENTS 4,923,428 A 5/1990 Curran
4,950,200 A 8/1990 Curran
5,011,449 A 4/1991 Handy et al.
5,029,214 A 7/1991 Hollander
5,096,451 A 3/1992 Smith et al.
5,100,138 A 3/1992 Wilde
5,108,341 A 4/1992 DeSmet
5,141,464 A 8/1992 Stern et al.
5,142,803 A 9/1992 Lang
5,158,492 A 10/1992 Rudell et al.
5,195,920 A 3/1993 Collier
5,213,510 A 5/1993 Freeman
5,236,385 A 8/1993 May
5,239,665 A 8/1993 Tsuchiya
5,270,480 A 12/1993 Hikawa
5,280,265 A 1/1994 Kramer et al.
5,298,700 A 3/1994 Champagne et al.
5,399,115 A 3/1995 Arad et al.
5,413,355 A 5/1995 Gonzalez
5,413,516 A 5/1995 Lam
5,468,172 A 11/1995 Basile
5,474,484 A 12/1995 Lemelle
5,478,240 A 12/1995 Cogliano
5,493,185 A 2/1996 Mohr et al.
5,493,281 A 2/1996 Owens
5,495,557 A 2/1996 Hyman et al.
5,501,627 A 3/1996 Ekstein
5,534,888 A 7/1996 Lebby et al.
5,607,336 A * 3/1997 Lebensfeld et al. ..... 446/297
5,636,994 A 6/1997 Tong
5,647,787 A 7/1997 Raviv et al.
5,648,999 A 7/1997 Easterling et al.
5,655,945 A 8/1997 Jani
5,656,907 A 8/1997 Chainani et al.
5,682,196 A 10/1997 Freeman
5,820,441 A 10/1998 Pracas
5,855,483 A 1/1999 Collins et al.
5,855,502 A 1/1999 Truchsess
5,873,765 A 2/1999 Rifkin et al.
5,989,091 A 11/1999 Rodgers
6,032,548 A * 3/2000 Del Castillo et al. ..... 74/89.19
6,048,209 A 4/2000 Bailey
6,135,848 A * 10/2000 Hou ..... 446/268
6,149,490 A 11/2000 Hampton et al.
6,159,011 A 12/2000 Moormann et al.
6,435,936 B1 8/2002 Rehkemper et al.
6,500,043 B1 * 12/2002 Fong ..... 446/330
6,652,351 B1 * 11/2003 Rehkemper et al. ..... 446/354

* cited by examiner

ANIMATED DOLL

FIELD OF THE INVENTION

The present invention is directed to dolls, and particularly to animated dolls.

BACKGROUND AND SUMMARY

Animated dolls are popular toys for children. Animated features increase the life-like appearance of the dolls, increasing their appeal to children. Examples of various interactive, animated or robotic dolls, are found in U.S. Pat. Nos. 4,775,352, 4,808,142, 4,900,289, 4,923,428, 4,950,200, 5,108,341, 5,399,115, 5,820,441, 5,855,502, and 6,149,490, the disclosures of which are incorporated herein by reference.

The present invention includes an animated doll having a combination of independent, interactive features that may make the doll more appealing to children. In the depicted embodiment, the doll may have an enlarged head and enlarged feet that control and provide power for the interactive features. One of the interactive features includes a head position assembly that controls rotation of the head relative to the body of the doll. A second interactive feature includes an eye assembly mechanism that drives and controls the opening and closing of eyelids on the doll. The doll also may include removable external components, such as accessories and clothing that may be attached to or removed from the doll to cause an associated response by the doll.

DETAILED DESCRIPTION AND BEST MODE OF THE INVENTION

Figure 1:
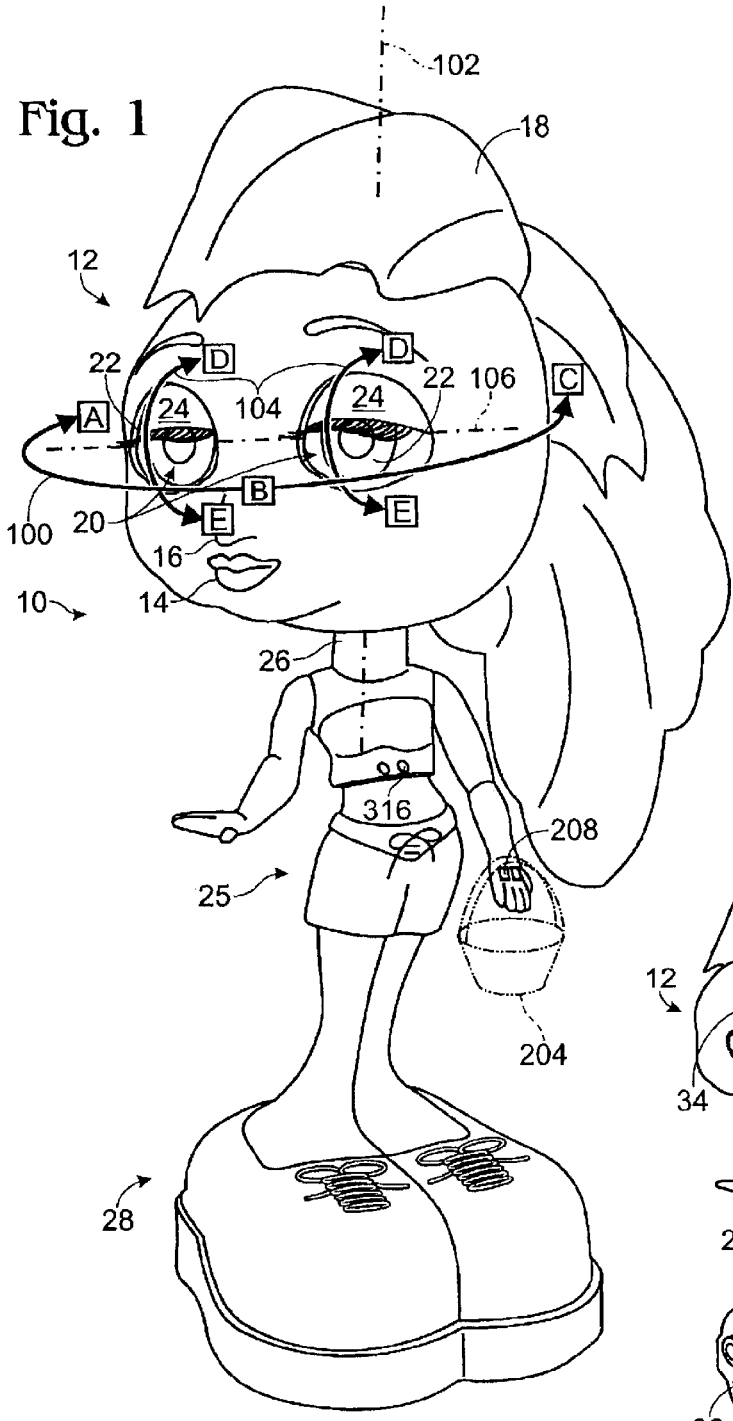
FIG. 1 is a perspective view of a doll, including an enlarged head and feet with interactive features.

Referring to FIG. 1, an interactive doll constructed according to the present invention is indicated generally at

10, and preferably resembles a reduced-scale human figure with very exaggerated proportions. Doll 10 also may be male, female, or androgynous, or may be any one of a variety of alternative forms which may be appealing to children, including but not limited to animals, fantasy figures, or animated objects. Doll 10 may be of any appropriate size, but preferably is constructed such that a small child may easily carry and manipulate doll 10.

Figure 2:
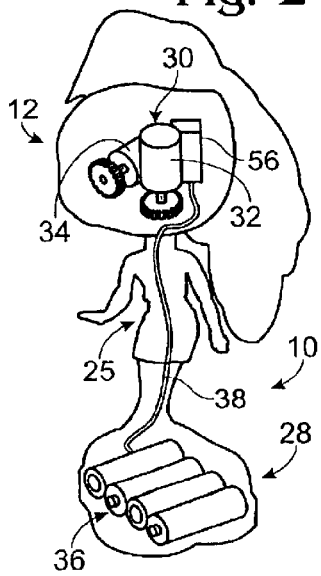
FIG. 2 is a perspective view of the doll as seen in FIG. 1, shown in outline form with a motor assembly and a battery assembly that may be included in the doll.

Doll 10 may be constructed of any suitable material. For example, doll 10 shown in FIGS. 1 and 2 is constructed of moldable plastic. The moldable plastic may be colored and shaped such that the doll has skin and features that resemble a human's skin and features. Alternatively, any other suitable material may be used to construct doll 10. Doll 10 may also be painted, or otherwise decorated, to increase the doll's appeal to children.

Doll 10 may include a head 12 that preferably includes typical facial features such as a mouth 14, a nose 16, hair 18, and an eye assembly 20 that includes eyes 22 and eyelids 24. The features or similar features may be painted on doll 10 or may be otherwise constructed to resemble the appropriate features. For example, hair 18, may be constructed of suitable stylable material such that hair 18 may be styled by a child. As depicted, hair 18 is long straight hair. However, hair 18 may be of any color, length, or texture. Additional facial features, depending on the form of doll 10, may also be included on head 12.

Doll 10 also may include a body or torso 25, a neck 26, and a base 28. Alternatively, head 12 may be connected directly to body 25, without any neck, or base 28 may be connected directly to head 12, with or without some type of simulated body incorporated within base 28. In the depicted embodiment, base 28 is shaped to resemble feet, however alternative configurations are within the scope of the invention.

As shown in FIG. 1, head 12 and base 28, preferably in the shape of feet, are enlarged. Body 25 of doll 10 is out of proportion to the size of either head 12 or base 28. The exaggeration of head 12 and base or feet 28 may make doll 10 more aesthetically appealing to a child or other consumer group.

In the preferred embodiment, the size of head 12 and feet 28 has functional qualities. In particular, the exaggerated features contain components for motion, as shown in FIG. 2. For example, head 12 may be configured to hold a motor assembly 30, preferably including head motor 32 and an eye motor 34.

Similarly, feet 28 are constructed to hold a battery assembly 36 (also referred to as a power assembly) or other power source. A set of wires or other conductive pathway 38 in body 25 couples battery assembly 36 in feet 28 to motor assembly 30 in head 12.

Doll 10 may be placed on a surface, such as a table, so that doll 10 remains in an upright standing orientation. Feet 28 stabilize doll 10 and support head 12 and body 25. The exaggerated feet 28, including battery assembly 36, effectively act as a counterweight to head 12 and body 25.

Referring back to FIG. 1, one animated feature of doll 10 is controlled rotational motion of head 12, as indicated by arrow 100. By controlling the motion of head 12, doll 10 takes on a more life-like appearance. Head 12 is moveable about a vertical or upright axis 102 that extends lengthwise through doll 10. Head 12 is moveable about axis 102 between at least two positions. For example, head 12 in FIG. 1 is moveable between three predetermined positions, including a right-facing position A, a center position or intermediate position B, and a left-facing position C.

Figure 3:
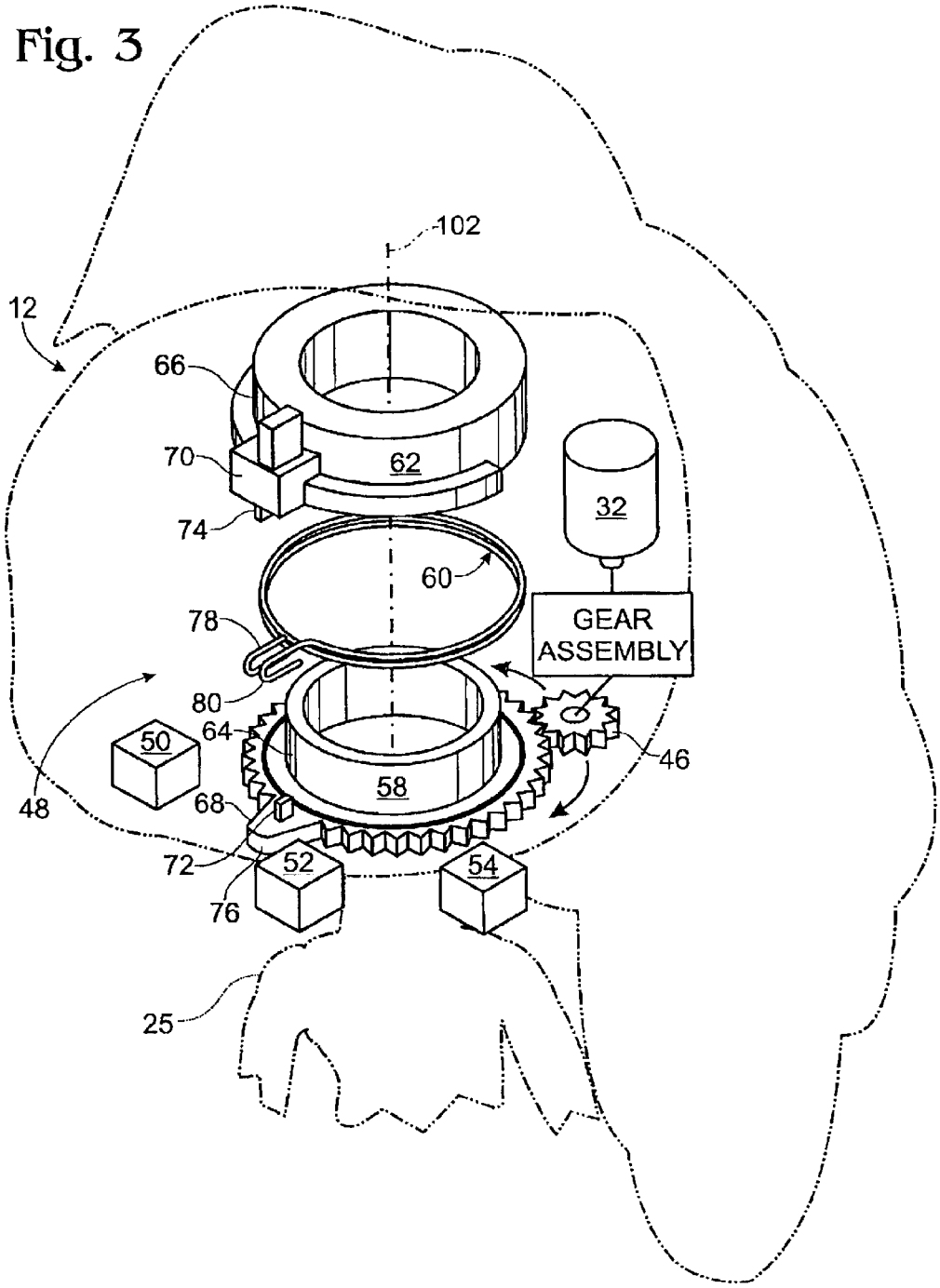
FIG. 3 is an exploded view of a head position assembly of the doll shown in FIG. 1, including a drive gear that is powered by one of the motor assemblies shown in FIG. 2, a toothed lower wafer upon which the drive gear acts, and limit switches triggered by movement of the head of the doll about the toothed wafer.

Turning now to FIG. 3, the electro-mechanical operation of head 12 may be more readily understood. As described above, head 12 moves relative to body 25. Head motor 32 drives a drive gear assembly, symbolically illustrated in FIG. 3, which in turn drives toothed gear 46. Gear 46 engages head position assembly 48, which identifies the position of head 12 relative to body 25.

Rotating gear 46 rotates head 12 relative to body 25 as gear 46 is driven around head position assembly 48. As head 12 rotates relative to body 25, gear 46 rotates about head position assembly 48. Head position assembly 48 remains in a substantially stationary position relative to body 25.

Head position assembly 48 is configured to contact a position monitoring structure on head 12. As shown, the position monitoring structure in the depicted embodiment includes limit switches 50, 52 and 54. Limit switches 50, 52, and 54 are anchored to head 12 such that their position relative to the body is effected by rotation of head 12.

Figure 4:
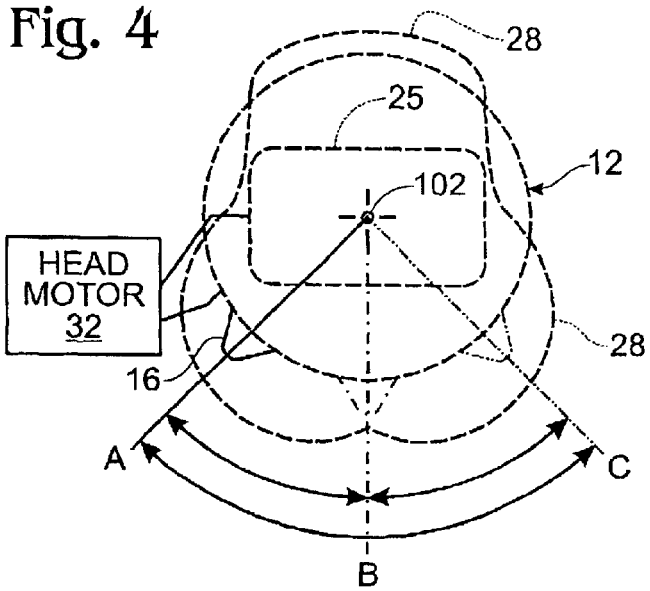
FIG. 4 is a pictorial and simplified top plan view of the doll of FIG. 1, showing the positions of the head relative to the body.

The rotation of head 12 relative to body 25 is demonstrated in FIG. 4, in which head 12 is schematically illustrated and is shown with a dashed line. FIG. 4 illustrates symbolically from an overhead perspective each of the three positions, shown in FIG. 1. The three exemplary positions include right-facing position A, forward-facing position B, and left-facing position C. Body 25 is symbolically illustrated as a rectangular box with dashed lines, and feet 28 are shown with dashed lines as well. Head motor 32 drives head 12 about axis 102 relative to body 25 and feet 28.

In FIG. 4, each position of head 12 relative to body 25 is identified by a different line quality. For example, right-facing position A, is illustrated with a solid line. Moreover, nose 16 is illustrated as facing the corresponding direction. Forward-facing position B, is represented by a dash dot line with the outline of nose 16 facing the forward direction. Likewise, left-facing position C, is shown in a dash double dot line with a corresponding outline of nose 16 as it would appear in this position. Although not shown, additional or alternative positions for head 12 are contemplated.

Head 12 is movable between each of positions A, B, and C. Hence, if head 12 starts in position A it may move to position B or to position C through position B. Similarly if head 12 starts in position C, it may move to position B or to position A through position B. Alternatively, if head 12 is in position B, then it may move to either position A or position C.

Figure 5:
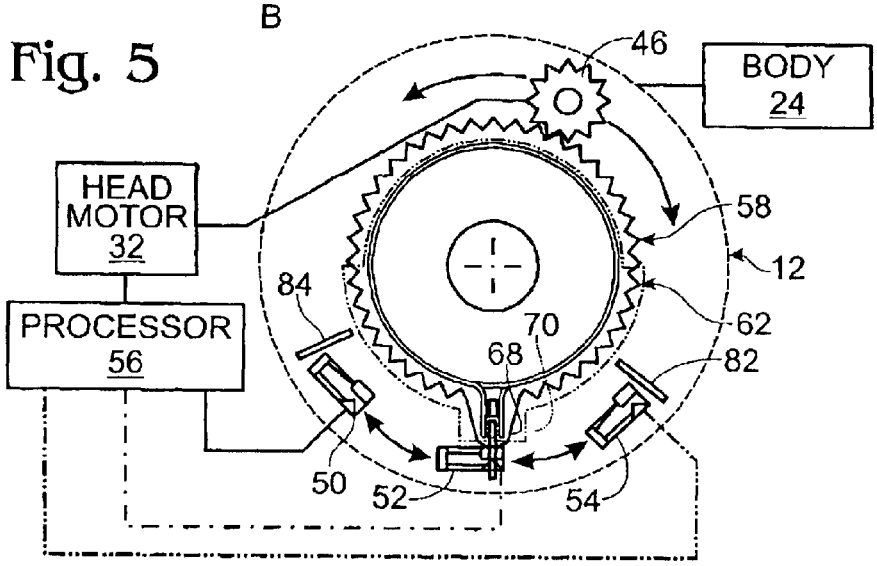
FIG. 5 is a top plan view of the drive gear, toothed wafer, upper wafer, and limit switches of FIG. 3.

All of the above movements may be controlled by a microprocessor, shown in FIG. 5 at 56. Each limit switch provides an independent signal to processor 56, relaying the position of head 12, as head position assembly 48 impacts each limit switch 50, 52, or 54. For example, when head 12 is in a right-facing position A, then head position assembly 48 contacts limit switch 50. Alternatively, when head 12 is rotated from position A to forward-facing position B, head position assembly 48 contacts limit switch 52. Similarly, when head 12 further rotates from position B to left-facing position C, head position assembly 48 contacts limit switch 54.

Processor 56 may also direct head motor 32 to drive head 12 to a different position forming a feedback loop. This feedback loop allows processor 56 to identify and position head 12 in particular predetermined positions, such as right-facing position A, forward-facing position B, or left-facing position C. Moreover, processor 56, as a result of the head position information, may direct additional responses, such as speech or other animation.

As described above, head position assembly 48 is designed to contact each limit switch when head 12 is in each of the predetermined head positions. The details of head position assembly 48 are seen best in FIG. 3. As shown in FIG. 3, head position assembly 48 includes a lower toothed wafer 58, a yielding biasing structure 60 and an upper wafer 62. Gear 46, which rotates with head 12 when driven by head motor 32, is configured to engage and rotate about lowertoothed wafer 58.

Upper wafer 62 is axially aligned with lower wafer 58 such that when head 12 is motor driven or at rest, lower wafer 58 and upper wafer 62 are parallel. Lower wafer 58 and upper wafer 62 are releasably coupled together. For example, as shown in FIG. 3, lower wafer 58 has a rim 64, which fits into a receiver portion 66 on upper wafer 62. Moreover, lower wafer 58 has an extended lobe 68, which extends outward from the body of lower wafer 58. When head position assembly 48 is in an operational position, which includes when head position assembly 48 is at rest or driven by head motor 32, lobe 68 of lower wafer 58 is aligned and parallel with a substantially matching extension 70 on upper wafer 62.

For example, as shown in the overhead view in FIG. 5, lobe 68 on lower wafer 58 is directly below extension 70 of upper wafer 62. During motor operation, lower wafer 58 and upper wafer 62 remain in the position shown in FIG. 5 where lobe 68 and extension 70 extend in a forward-facing direction relative to body 25, akin to position B in FIG. 4.

Returning attention again to FIG. 3, lobe 68 of lower wafer 58 has an upward projection 72. Upper wafer 62 has a similar projection 74 on extension 70. Upward projection 72 lies adjacent to downward projection 74 when head position assembly 48 is motor driven or at rest. When upward projection 72 and downward projection 74 are adjacent, upper wafer 62 and lower wafer 52 are aligned and parallel with identical orientations relative to body 25. Lower wafer 58 also has a contact surface 76, which is configured to contact the limit switches 50, 52, and 54 as head 12 moves between the predetermined positions.

Interposed between lower wafer 58 and upper wafer 62 is yielding biasing structure 60. Yielding biasing structure 60, as shown in FIG. 3, may be a spring or other suitable structure that coils around rim 64 of lower wafer 58. Spring 60 has paddles or ends 78 and 80 which sandwich upward projection 72 on lower wafer 58 and downward projection 74 on upper wafer 62 aligning lobe 68 of lower wafer 58 with extension 70 of upper wafer 62.

Lower wafer 58 and upper wafer 62 are releasably locked together through spring 60. The drive force from head motor 32 on lower wafer 58 and upper wafer 62 is not enough to overcome the tension of spring 60, and hence, spring 60 restrains upper wafer 62 such that as a unit, lower wafer 58 and upper wafer 62, remain stationary when head 12 is rotated by motor 32.

Figure 6:
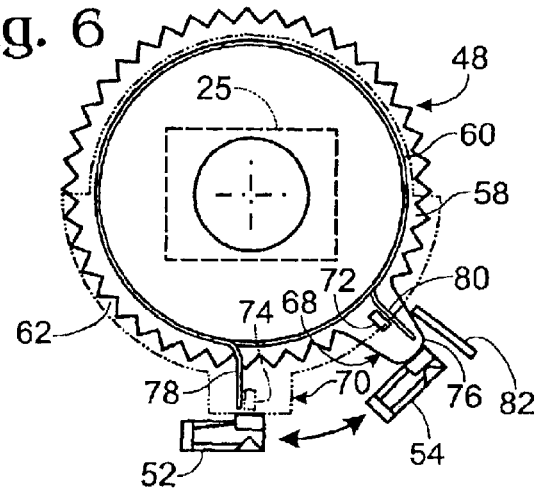
FIG. 6 is a top plan view of the toothed wafer and limit switches shown in FIG. 5, where the head of the doll has been forced to a turned position without a corresponding movement of the upper wafer.

FIG. 6 demonstrates the effect of spring 60 when head 12 is forcibly physically turned from an operational position without head motor 32 or when body 25 and/or feet 28 are rotated while holding head 12 stationary. Spring 60 acts as a protective safety device or mechanism, which increases the useable life of doll 10 by preventing the gears from being stripped or otherwise misaligned within head assembly 48 when an external force is exerted on head 12. Physically wrenching head 12 to one side, or rotating body 25 while holding head 12 still, exceeds the tension of spring 60 thereby permitting lower wafer 58 to move independently of upper wafer 62. Lower wafer 58 follows the rotation of head 12, while upper wafer 62 follows the position of body 25.

For example, as shown in FIG. 6, head 12 has been forcibly turned to the right from an operational position such that head 12 is in position C shown in FIG. 3. The force exerted by spring 60 is exceeded and lower wafer 58 follows the rotation of head 12 and contact surface 76 engages limit switch 54. However, upper wafer 62 remains in its original position in line with the center plane of body 25 of doll 10. Paddle 78 of spring 60 rests on the outside of downward projection 74 on upper wafer 62 and paddle 80 of spring 60 rests on the outside of upward projection 72 on lower wafer 58. As head 12 is forcibly rotated, lower wafer 58 follows rotation of head 12 and spring 60 is drawn apart. Once pressure is released from head 12, spring 60 biases head 12 and lower wafer 58 back to the resting and motor operation position where lobe 68 of lower wafer 58 is aligned and parallel with extension 70 of upper wafer 62 as shown in FIG. 5.

Head position assembly 48 has additional safety mechanisms. Physical stops 82, 84, shown in FIGS. 5 and 6, prevent a child from turning the doll's head beyond a predetermined range. Stops 82 and 84 work in combination with spring 60 to prevent head position assembly 48 from becoming inoperable due to a child's play. Head position assembly 48 includes a stopping surface that engages stops 82 and 84 when head 12 is physically rotated beyond the predetermined range of positions. Moreover, as illustrated in FIG. 6 and described above, spring 60 is drawn apart as the tension of spring 60 is exceeded and head 12 is forcibly turned. The stopping surface on head position assembly 48 contacts stop 82 or 84, and when the physical pressure on head 12 is released, head 12 is biased by spring 60 back to the resting position or operation position, (shown in FIG. 5) where lobe 68 on lower wafer 58 is aligned with extension 70 on upper wafer 62.

Alternative mechanisms for head position assembly 48 are contemplated. For example, gear 46 may engage upper wafer 62 or an intermediate wafer (not shown). Likewise, limit switches 50, 52, and 54 may be positioned such that upper wafer 62 engages contact with the switches. Moreover, upper wafer 62 may turn with head 12, when head 12 is forcibly turned, while lower wafer 58 remains stationary.

A second interactive feature of doll 10 is the animation of eye assembly 20. As described previously, eye assembly 20 includes eyes 22 and eyelids 24. In FIG. 1, eyelids 24 are moveable, as indicated by arrows 104 about a substantially horizontal axis 106. For example, as illustrated in FIG. 1, eyelids 24 are moveable between an open position D and closed position E.

Figure 7:
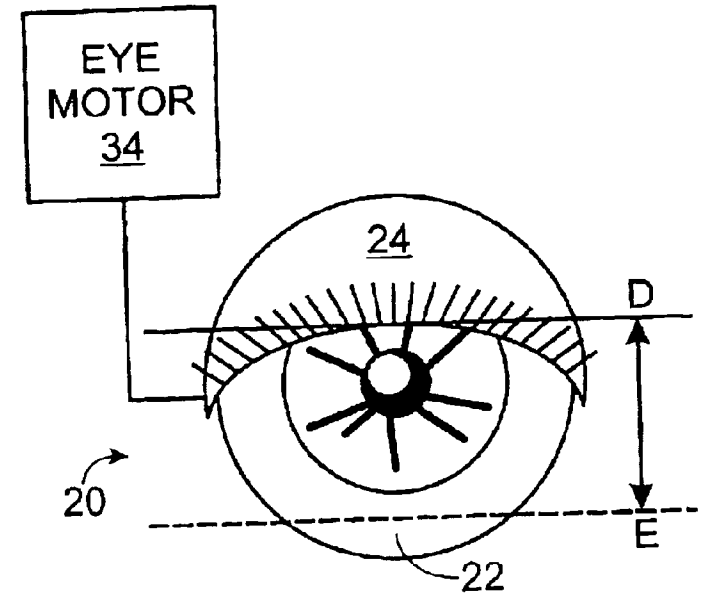
FIG. 7 is a front view of an eye assembly of the doll of FIG. 1.

FIG. 7 shows a representation of a single eye 22 and eyelid 24. Open eye position D is shown where eyelid 24 is raised. Closed eye position E is shown by a dashed line representing the position of eyelid 24. In the closed eye position E, eyelid 24 extends downward over eye 22 such that eye 22 is substantially covered by eyelid 24. Eye motor 34 drives the motion of eyelid 24, which is a separate motor from head motor 32, which drives head position assembly 48. By using separate motors for head rotation and eyelid motion, head rotation can operate independently and out of sequence with eyelid motion and vice versa.

Figure 8:
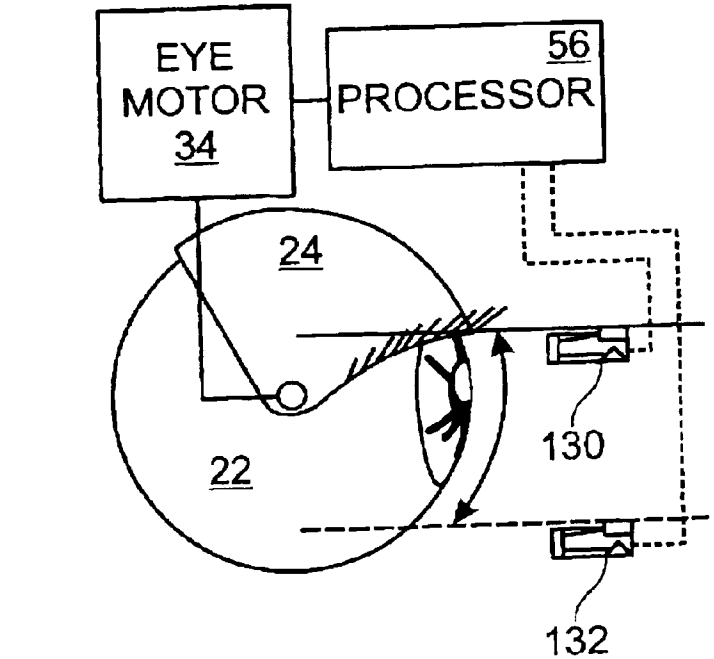
FIG. 8 is a side view of the eye assembly shown in FIG. 7.

FIG. 8 shows details of an eye assembly mechanism. Eye motor 34 drives gears or other suitable mechanical system to effect eyelid 24 to be able to move between open position D and closed position E. Eyelid 24 is configured to contact a position monitoring structure or limit switches 130 and 132 when in the corresponding positions D and E. Each limit switch is coupled to processor 56, which then drives eye motor 34 and eye assembly mechanism. Processor 56, which controls the eye assembly mechanism, may be the same processor that directs head position assembly 48. Alternatively, two separate processors may be used, with or without communication between the processors.

Figure 9:
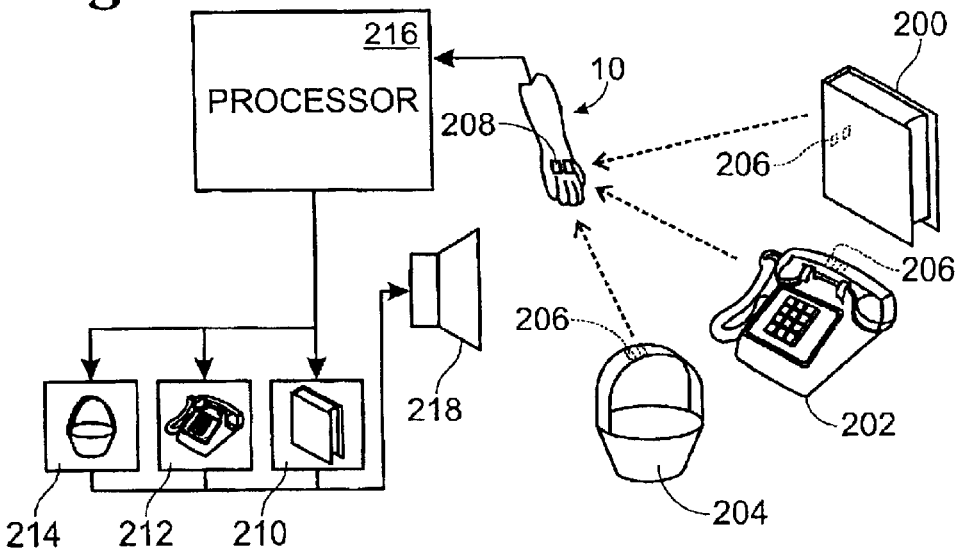
FIG. 9 is a schematic representation of an interactive feature of the doll of FIG. 1 showing accessories that may be attached to the doll to elicit an associated response.

Doll 10 may also have additional interactive features. As shown in FIG. 9, doll 10 may have a plurality of detachable/attachable accessories or external components, which may be removably attached to doll 10. These accessories may be shaped to identify a particular activity. For example, the accessories may include a diary 200, a telephone 202, a handbag 204, or any other object. Each accessory preferably has a contact region 206, which may be matched with a corresponding contact region or communication port 208 on doll 10. Contact region 206 may be read electronically by a microprocessor, such as processor 56, through the incorporation of a resister, capacitor, memory chip, or other electronic element.

By way of illustration, FIG. 9 shows contact region 208, which is positioned on the top of the doll's hand. Each accessory may be removably attached to the doll's hand to elicit a predetermined response. Once the contact region 206 of each accessory engages the contact region 208 on doll 10, the information regarding the attached accessory is relayed to processor 216. Processor 216 recognizes which accessory has been attached and responds according to the particular accessory attached to contact region 208. Processor 216 may be a separate processor from the processors described above, or alternatively processor 216 may be the same processor that controls head position assembly 48 or the eye assembly shown in FIGS. 7 and 8.

The particular accessory attached to doll 10 effects a particular response. For example, if diary 200 is attached to contact region 208 of doll 10, then doll 10 responds with diary interactive response 210. Likewise, if telephone accessory 202 or handbag 204 is attached to contact region 208, then doll responds with associated responses 212 or 214, respectively. The interactive responses may include prerecorded speech or games, which may be emitted from a speaker 218. Speaker 218 may be contained anywhere in doll 10, such as head 12, body 25, or feet 28. Alternatively, the interactive responses may include doll 10 opening and closing eyelids 24 or rotation of head 12. Moreover, interactive responses may include any other electromechanical response.

Figure 10:
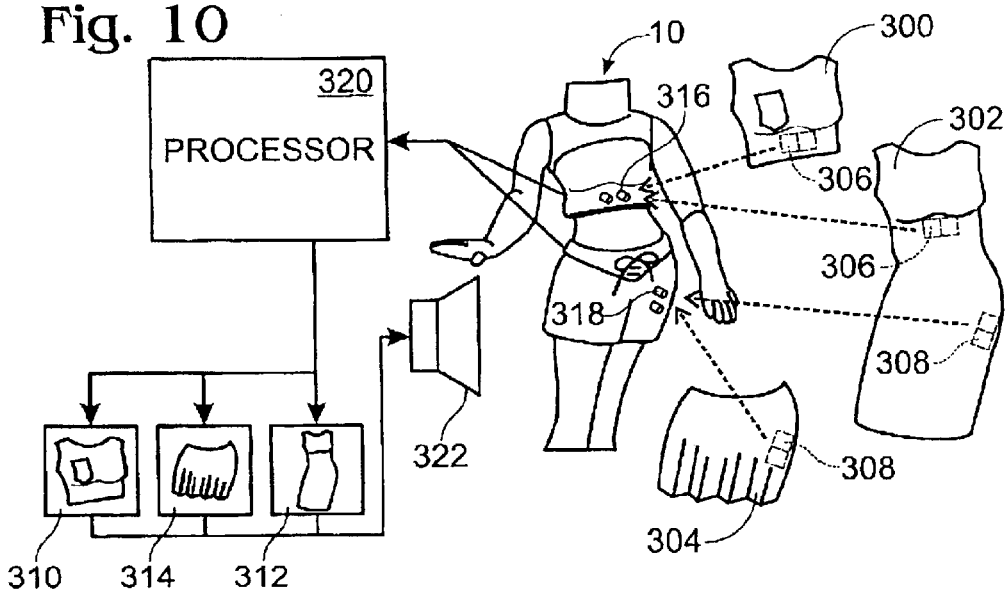
FIG. 10 is a schematic representation of an interactive feature of the doll of FIG. 1 showing clothes that may be attached to the doll to elicit an associated response.

FIG. 10 shows another interactive feature of doll 10 using a different communication port and different external components. Doll 10 may have a plurality of detachable/attachable clothing that allows a child to dress doll 10. Doll 10 may then respond according to the particular outfit attached to doll 10. For example, as shown in FIG. 10, doll 10 may have attachable tops 300, dresses 302, skirts 304, pants, shorts or other articles of clothing or accessories. Each article of clothing has at least one contact region 306 (similar to contact 206) that corresponds to at least one contact or communications port on body 25 of doll 10. Doll 10, as shown, has two contacts, an upper torso portion of contacts 316, and a lower body pair of contacts 318, which are similar in function to contacts 208.

When doll 10 is dressed in the attachable clothing, information regarding the outfit on doll 10 is relayed to processor 320. Processor 320 may be the same processor as the processor used for any or all of the above described interactive features of doll 10. Alternatively, processor 320 may be an independent processor. Processor 320 recognizes which outfits are on doll 10 and responds accordingly. Hence, if top 300 is attached to doll 10, then processor 320 will direct a predetermined response 310 associated with top 300. Similarly, if dress 302 or skirt 304 is attached to doll 10, then doll 10 will respond with the associated response 312 or 314, respectively. Moreover, different shaped or colored tops, dresses, skirts, shorts, etc. all may elicit variable responses from doll 10.

Responses associated with each of the outfits attached to doll 10 may include speech or games through speaker 322. Speaker 322 may be the same speaker as speaker 218 or may be an alternative speaker. Moreover, speaker 322 may be positioned anywhere on doll 10. Alternatively, doll 10 may respond to the outfits by opening and closing eyelids 24, rotating head 12 or any other similar electro-mechanical response.

Doll 10 may include additional features, such as user input devices or switches (not shown). The user may be able to direct a response from doll 10. The user input devices may be positioned anywhere on doll 10, including head 12, body 25, or feet 28. Similarly, doll 10 may also include an on/off switch for powering motors 32 and 34. The on/off switch may be located anywhere on doll 10, for example, on the under-surface of feet 28.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and sub-combinations of the various elements, features, functions and/or properties disclosed herein. Where claims recite "a" or "a first" element or equivalent thereof, such claims should be understood to include incorporation of one or more such elements, neither requiring, nor excluding two or more such elements.

It is believed that the following claims particularly point out certain combinations and sub-combinations that are directed to one of the disclosed inventions and are novel and non-obvious. Inventions embodied in other combinations and sub-combinations of features, functions, elements and/or properties may be claimed through amendment of those claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

We claim:

1. An interactive doll with an animated head and a base, the doll comprising:

a motor operatively connected to the head, the head rotatable relative to the base through a plurality of predetermined head positions including a first head position;

a head position assembly interposed between the head and the base, the head position assembly having a contact surface; and a position monitoring structure attached to the head and independent of the head position assembly, the position monitoring structure configured to monitor the plurality of predetermined head positions, wherein the positioning monitoring structure rotates with the head, such that the contact surface of the head position assembly triggers the position monitoring structure when the head is in the first head position.

2. The doll of claim 1, wherein the head position assembly comprises a safety mechanism adapted to permit the head to be physically turned by an external force.

3. The doll of claim 1, wherein the head position assembly comprises:

a lower wafer interposed between the head and the base adapted to follow the rotation of the head when the head is physically turned by an external force from an operational position;

an upper wafer releasably coupled to the lower wafer and adapted to remain aligned with the base when the head is physically turned by an external force from the operational position; and a biasing structure interposed between the lower wafer and upper wafer wherein the biasing structure is adapted to bias the head back to the operational position after being physically turned by the external force.

4. The doll of claim 1, wherein the head position assembly comprises a stopping surface which is adapted to contact a stop on the head to prevent the head from being physically turned by an external force beyond the plurality of positions.

5. The doll of claim 1, wherein the position monitoring structure includes at least one limit switch.

6. The doll of claim 1, wherein the position monitoring structure is operatively attached to a processor which is adapted to control rotation of the head.

7. The doll of claim 1 wherein the base is shaped to resemble feet configured to disguise a power source; and the head is configured to disguise the motor assembly which is operatively connected to the power source.

8. The doll of claim 1, also comprising an eye assembly having moveable eyelids, wherein a second motor is configured to move the eyelids between an open position and a closed position.

9. The doll of claim 1, wherein the head rotates about the head position assembly and the head position assembly remains generally stationary in relation to the base when in an operation position.

10. The doll of claim 1, wherein the head position assembly includes a biasing structure adapted to permit the head to be physically turned by an external force from the first head position to a second head position and upon release return to the first head position.

11. The doll of claim 1, wherein the base is adapted to provide a counter-weight to support the head.

12. The doll of claim 1, wherein the base is adapted to support the doll on a planar surface in an upright orientation.

13. An interactive doll with an animated head and a base, the doll comprising:

a motor operatively connected to the head, the head rotatable relative to the base through a plurality of predetermined head positions including a first head position;

a head position assembly interposed between the head and the base, the head position assembly having a contact surface adapted to remain substantially stationary relative the base upon rotation of the head by the motor; and a position monitoring structure attached to the head configured to monitor the plurality of predetermined head positions, the positioning monitoring structure rotatable with the head such that the contact surface of the head position assembly triggers the position monitoring structure as the head rotates by the motor through the plurality of predetermined head positions;

wherein the head is adapted to be physically turned by an external force from the first head position to a second head position and upon release return to the first head position.

14. The doll of claim 1, further including a body having a size, wherein a size of the head is exaggerated relative the size of the body.

15. The doll of claim 14, wherein a size of the base is exaggerated relative the size of the body.

16. The doll of claim 13, also comprising an eye assembly having moveable eyelids, wherein the motor assembly includes a second motor configured to move the eyelids between an open position and a closed position.

17. The doll of claim 13, further including a body having a size, wherein a size of the head is exaggerated relative the size of the body.

18. The doll of claim 17, wherein a size of the base is exaggerated relative the size of the body.

19. The doll of claim 13, wherein the base is shaped to resemble feet configured to disguise a power source.

* * * * *